US005653296A

United States Patent [19]

Fujiyama

[11] Patent Number: 5,653,296

[45] Date of Patent: Aug. 5, 1997

[54] SWITCH-LOCKING MECHANISM FOR SCREW TIGHTENER

[75] Inventor: Takeo Fujiyama, Tokyo, Japan

[73] Assignee: Max Co., Ltd, Tokyo, Japan

[21] Appl. No.: 519,938

[22] Filed: Aug. 28, 1995

[30] Foreign Application Priority Data

Aug. 30, 1994 [JP] Japan ..... 6-228674

[51] Int. Cl.[6] ..... H01H 9/20

[52] U.S. Cl. ..... 173/217; 173/170; 173/171

[58] Field of Search ..... 173/217, 162.1, 173/162.2, 170, 171

[56] References Cited

U.S. PATENT DOCUMENTS

| | | | |
|---|---|---|---|
| 3,632,936 | 1/1972 | Piber | 173/170 |
| 3,746,813 | 7/1973 | Brown | 173/170 |
| 3,746,815 | 7/1973 | Drummer | 173/170 |

FOREIGN PATENT DOCUMENTS

| | | |
|---|---|---|
| 0578755 | 7/1946 | United Kingdom . |
| 1229198 | 4/1971 | United Kingdom . |
| 1448730 | 9/1976 | United Kingdom . |
| 1449757 | 9/1976 | United Kingdom . |
| 1495471 | 12/1977 | United Kingdom . |

*Primary Examiner*—Scott A. Smith

*Attorney, Agent, or Firm*—Cushman Darby & Cushman, IP Group of Pillsbury Madison & Sutro, LLP

[57] ABSTRACT

A switch-locking mechanism in a screw tightener in which a motor for rotating a driver bit is activated by pulling a trigger, includes: a mating projection provided on the trigger; a trigger block slidably accommodating the trigger in part such that the mating projection of the trigger is positioned in the trigger block, the trigger block being fixed to the screw tightener body; a first spring urging the trigger in a opposite direction to the trigger pulling direction at all times; and a slide locker operative in a direction perpendicular to the trigger pulling direction, the slide locker having a locking projection movable in and out the moving locus of the mating projection of the trigger.

5 Claims, 6 Drawing Sheets

SWITCH-LOCKING MECHANISM FOR SCREW TIGHTENER

BACKGROUND OF THE INVENTION

1. Field of the Invention

The present invention relates to a mechanism for locking a switch in a screw tightener in an operative state so as to maintain operation of the screw tightener, or in an inoperative state so as to prevent operation of said screw tightener.

2. Description of the Related Art

Screw tighteners are used for tightening screws normally by pulling triggers to activate motors for rotating driver bits. It is however preferred that the trigger be designed to lock in an inoperative position so that the trigger cannot be carelessly pulled to thereby preventing any possible malfunction. Moreover, it is also preferred to be able to lock the trigger in an operative position so as to be able to tighten screws while the driver bit is kept rotating when the screw-tightening operation is continuously performed.

In order to meet the above-mentioned needs, there has heretofore been proposed and adopted locking mechanisms capable of either for restraining a trigger from being pulled or preventing the operation of a motor from being suspended.

However, locking mechanisms which function in both ways have been non-existent.

SUMMARY OF THE INVENTION

In view of the foregoing, an object of the present invention that has been materialized is to provide a switch-locking mechanism in a screw tightener that is capable of restraining a trigger from being pulled and also is capable of preventing the operation of a motor from being suspended.

In order to accomplish the aforementioned object, the present invention provides a switch-locking mechanism in a screw tightener in which a motor for rotating a rotatable driver bit is activated by pulling a trigger, the mechanism including: a mating projection provided on the trigger; a trigger block slidably accommodating the trigger at least in part such that the mating projection of the trigger is positioned in the trigger block, the trigger block being fixed to the screw tightener body (housing); a first spring urging the trigger in a opposite direction to the trigger pulling (activating) direction at all times; and a slide locker operative in a direction perpendicular to the trigger pulling direction, the slide locker having a locking projection movable in and out the moving locus of the mating projection of the trigger.

With the arrangement above, the slide locker is normally held in the upper (e.g., first) position. When the screw tightener is driven by pulling the trigger, the trigger moves deeply inward along the guide groove of the trigger block and the contact piece of its insert piece passes through the lower slit of the slide locker, so that a first spring is bent. When the pulling action toward the slide locker is released, the trigger is pushed back by the first spring in the direction opposite to the direction in which it is pulled (forward) and reset to the initial position.

Subsequently, while the screw tightener is not used after completion of the work, for example, the slide locker is pushed down by means of a knob to the lower (e.g., second) position, whereby a projection beneath the end plate of the T-shaped piece of the slide locker moves onto the moving locus of the mating projection of the trigger. Consequently, the trigger cannot be pushed into the trigger block since the mating projection engages with the projection of the slide locker even when it is attempted to pull the trigger in that state. As the trigger is locked so that it is not pulled like this, malfunction can effectively be prevented.

When the motor is desired to be kept running even after the trigger is released from being pulled during the screw-tightening operation, moreover, the slide locker is pushed down to the lower position after the trigger is pulled to move the projection beneath the T-shaped piece of the slide locker onto the moving locus of the mating projection of the trigger. When the trigger is released from being pulled in this state, the mating projection of the trigger engages with the projection of the slide locker in the course of its return movement, whereby the reset movement of the trigger is arrested. The motor can thus be locked so as not to stop running, which makes it possible to perform the screw-driving operation continuously while the driver bit is kept rotating.

Since the contact piece of the insert piece of the trigger is forced into the upper slit of the slide locker in this case, the slide locker is not allowed to make an upward reset movement. On the contrary, by forcing the trigger in against the force of the first spring again, the contact piece is released from mating with the upper slit and the slide locker is reset by a second spring to the upper position; the locking condition above is released accordingly.

As set forth above, this locking mechanism is capable of locking the trigger in an inoperative position so as not to be pulled and also is capable of locking the motor in an operative state so that it does not stop running. Improvement in safety as well as operability can thus be accomplished.

BRIEF DESCRIPTION OF THE DRAWINGS

FIG. 2(*b*) shows a sectional view taken on line X—X of FIG. 2(*a*);

DETAILED DESCRIPTION OF THE PREFERRED EMBODIMENTS

Figure 1:
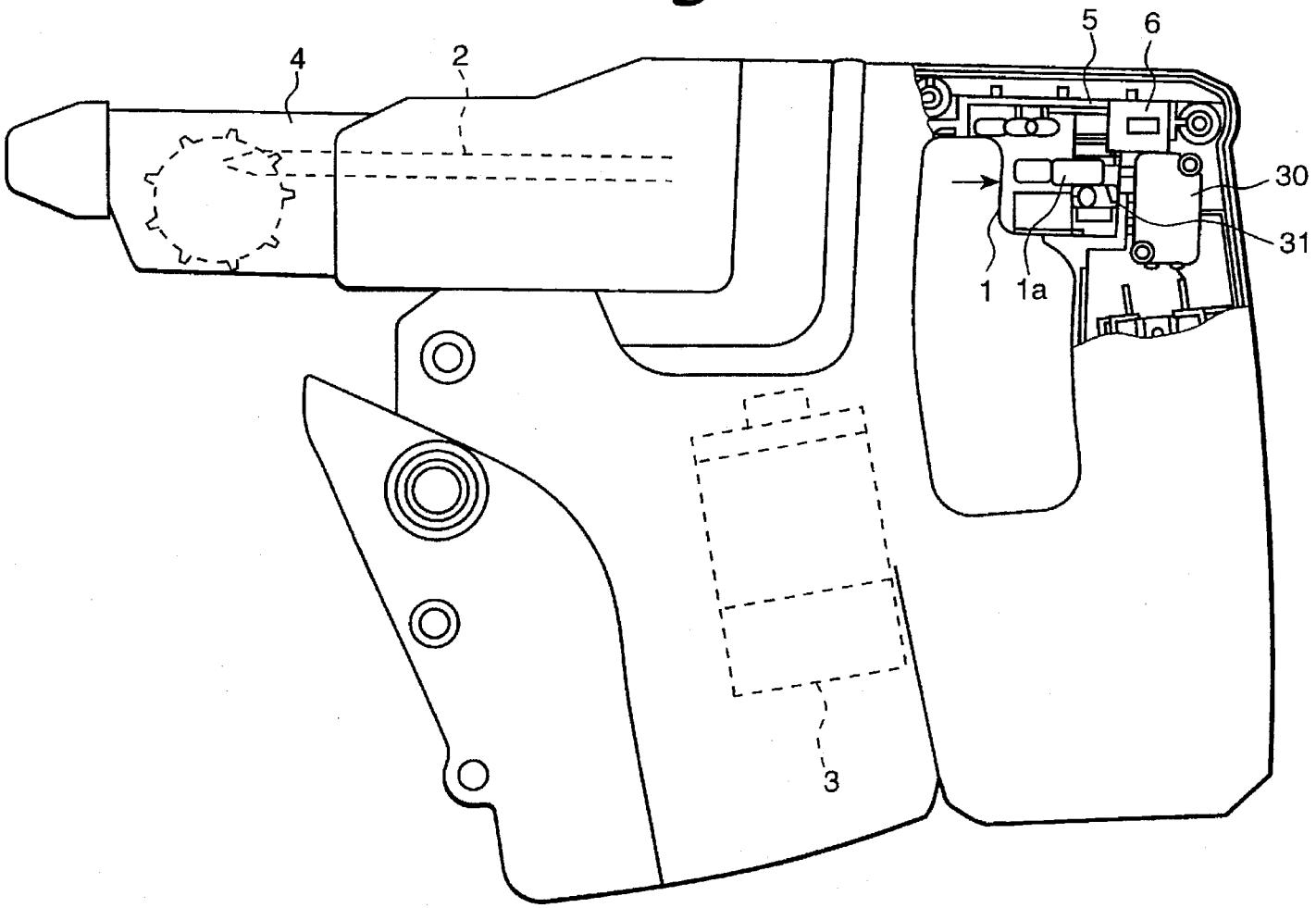
FIG. 1 shows a schematic diagram illustrating a screw tightener according to the present invention.

FIG. 1 is a schematic diagram of a screw tightener. In the screw tightener, when a trigger 1 is pulled, a switch rod 1*a* fitted to the trigger 1 pushes the contact part 30*a* (FIGS. 8 and 9) of a switch 30 to drive a motor 3 for rotating a driver bit 2, so that the screw supplied to a nose portion 4 is driven into a material to be screwed down.

Figure 8:
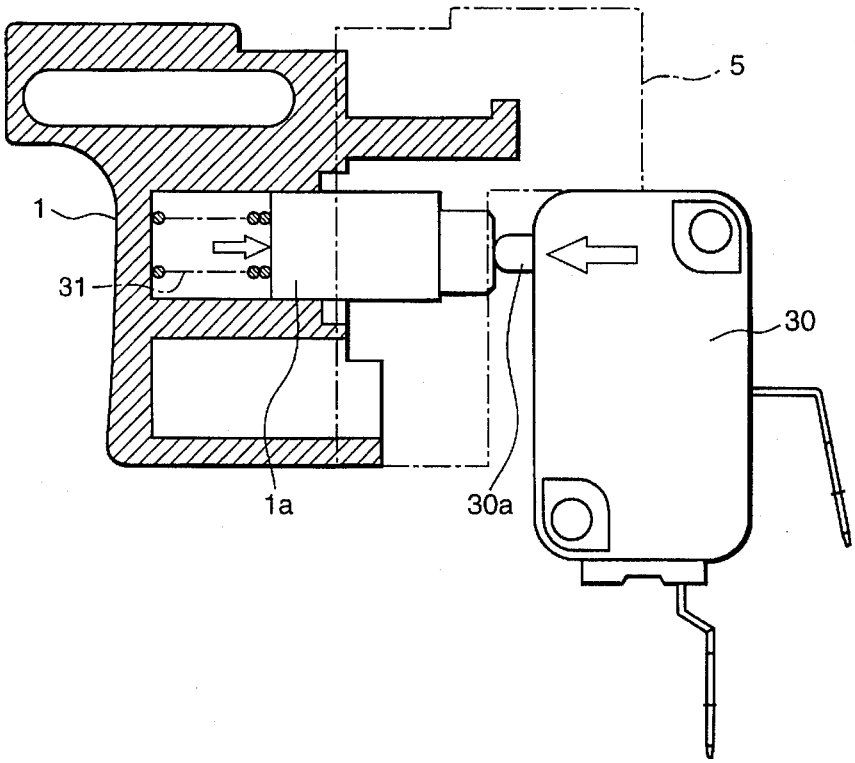
FIG. 8 shows a diagram illustrating a switch unit before the trigger is pulled.
Figure 9:
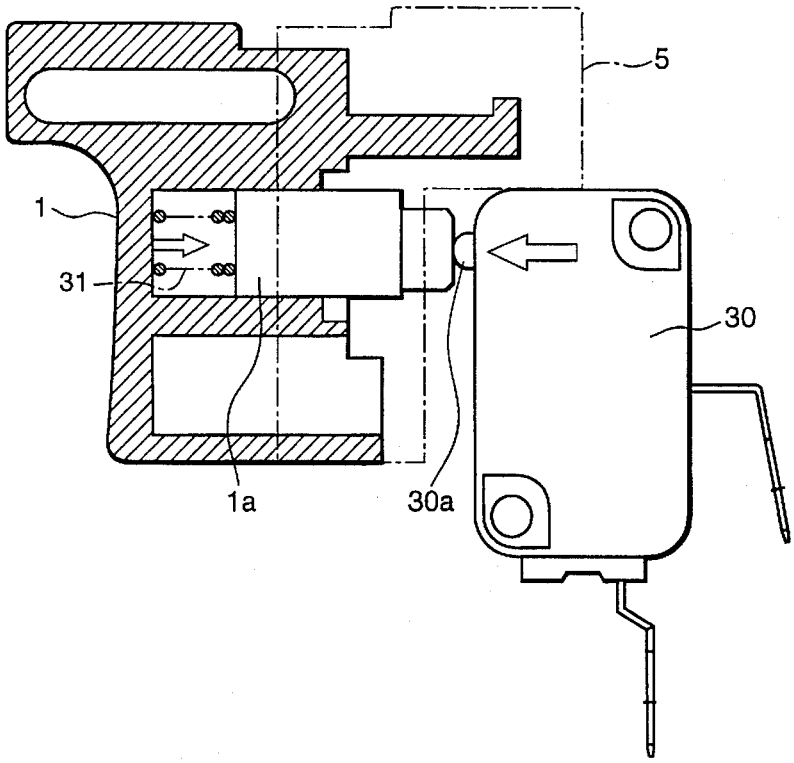
FIG. 9 shows a diagram illustrating the switch unit after the trigger is pulled.

In this case, the spring load of a spring 31 for pushing out the switch rod 1*a* is set in such a manner that, as shown in FIG. 8, the spring load thereof remains smaller than a spring load at the contact part 30*a* of the switch 30 to hold the switch 30 "off" until the trigger 1 is pulled. As shown in FIG. 9, the spring load of the spring 31 becomes greater than the spring load at the contact part 30*a* to turn the switch 30 "on" when the trigger 1 is pulled.

Figure 2A:
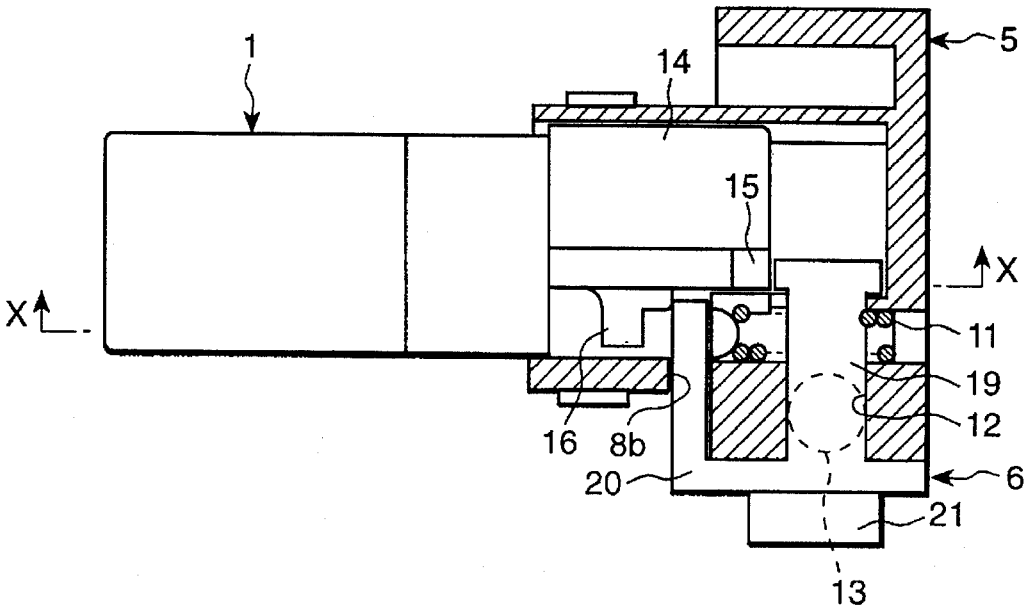
FIG. 2(*a*) shows a top view of the screw tightener whose locking mechanism is shown in cross section with an exposed trigger block excluding its upper wall.
Figure 2B:
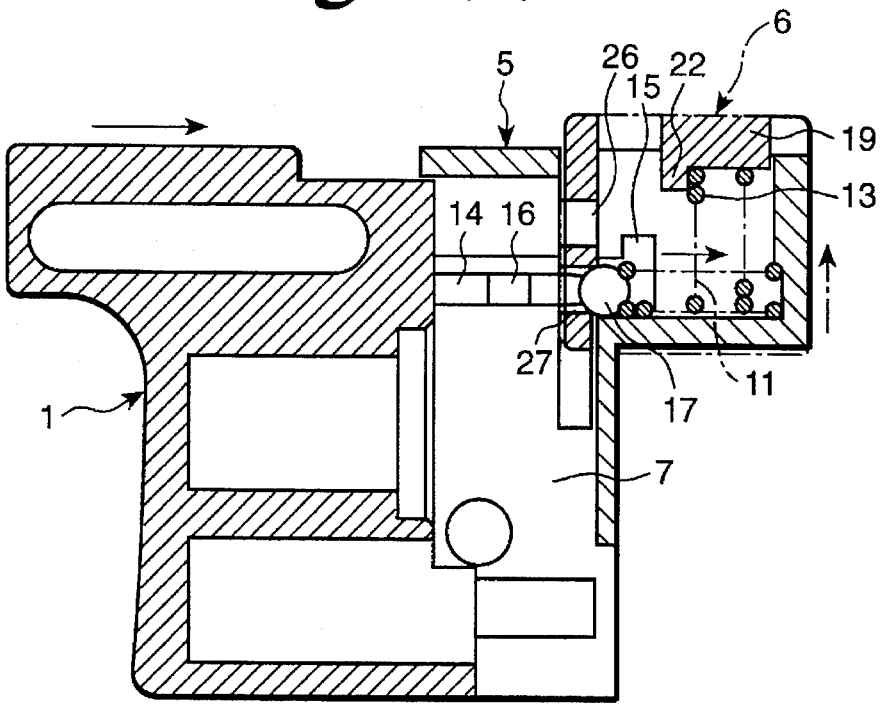
Figure 3:
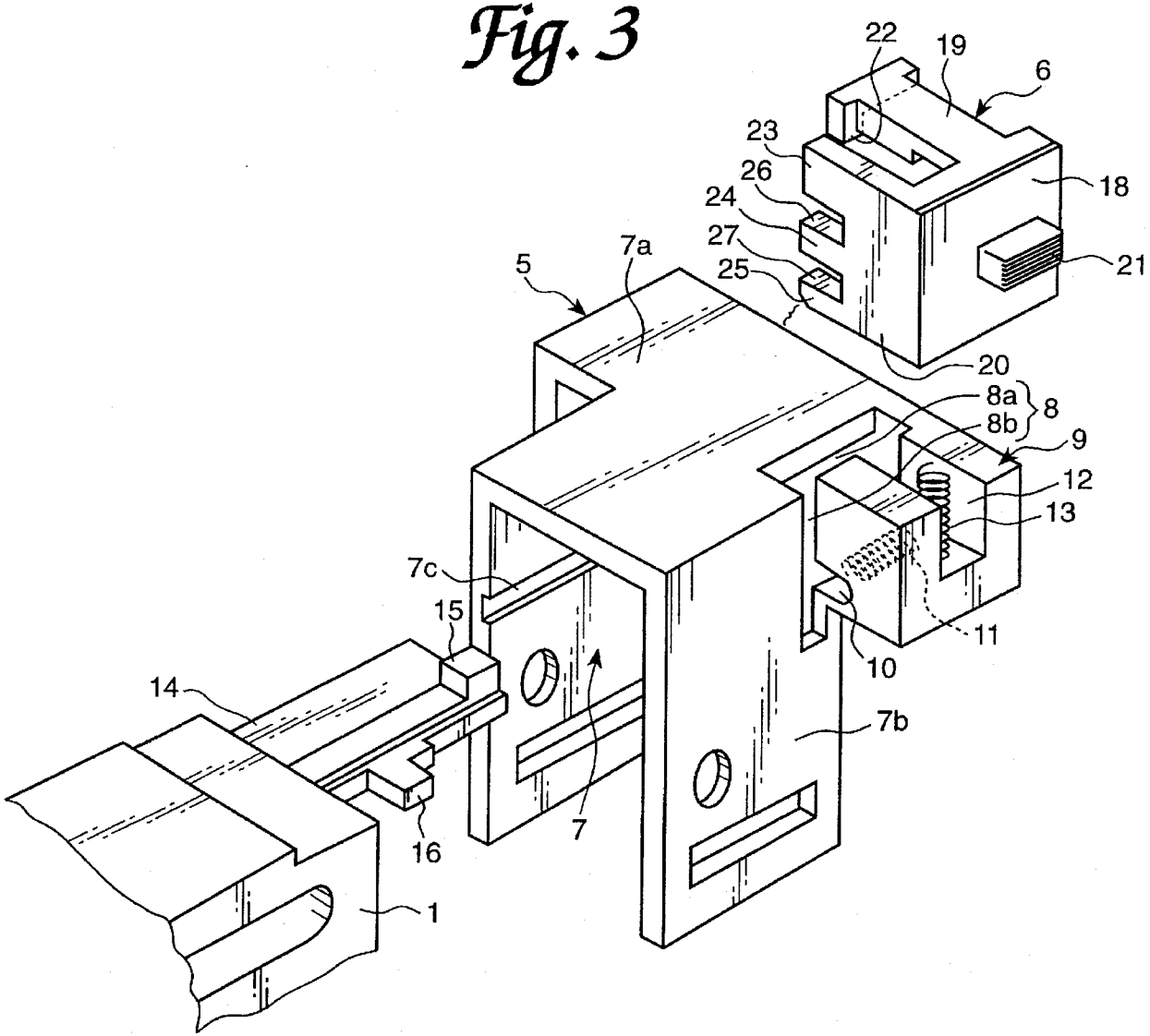
FIG. 3 shows an exploded perspective view of the locking mechanism in the screw tightener.

The screw tightener as described above is equipped with a switch-locking mechanism activatable by means of the trigger 1. The locking mechanism includes, as shown in FIGS. 2 and 3, a trigger block 5 secured to the screw tightener body and used for slidably housing the trigger 1, and a slide locker 6 which is movable in a direction perpendicular to the direction in which the trigger 1 is pulled.

The trigger block 5 is supplied with a container 7 for housing the trigger 1, the container being inverted-U-shaped. Further, the guide groove 7*c* for receiving the trigger 1 is formed in one side wall of the container 7, and a slide-locker receiving part 9 in the form of a block is projected sidewise via an L-shaped cutout 8 in transverse cross section, the L-shaped cutout being continuous with the upper rear of the container 7. Of the L-shaped cutout 8, the longitudinal cutout 8*a* is continuous with the upper wall 7*a* of the container 7, whereas the lateral cutout 8*b* is continuous with the upper wall 7*a* and the sidewall 7*b* thereof. A spring-receiving hole 10 is longitudinally formed on the lower inner side of the receiving part 9, and a first spring 11 is longitudinally installed therein. Moreover, a groove 12 upwardly opened is formed in the rear of the receiving part 9, and a second spring 13 is vertically installed therein.

An insert piece 14 is projected in the upper rear of the trigger 1, and a mating projection 15 is formed at the upper forward end (rear end) of the trigger 1. Further, a contact piece 16 is projected from one side of the insert piece 14. The trigger 1 is so sized that it can fit into the container 7 of the trigger block 5, and it is accommodated from the front of the container 7, the other side of the insert piece 14 being mated with the guide groove 7*c*. When the trigger 1 is housed in the trigger block 5, the contact piece 16 is arranged so as to contact the first spring 11 via a ball 17. Consequently, the trigger 1 is longitudinally slidable with respect to the trigger block 5, and normally urged by the spring 31 (FIG. 1) in a direction opposite to the direction in which it is pulled back.

The slide locker 6 has a T-shaped piece 19 projected from the upper part of a square plate member 18, and a side plate portion 20 projected from one side. A knob 21 is formed in the center of the square plate member 18, and a projection 22 projecting downward from the lower front end of the T-shaped piece 19. Further, three leg pieces 23, 24, 25 are projected from the side plate portion 20: an upper slit 26 being formed between the upper and central leg pieces 23, 24, a lower slit 27 between the central and lower leg pieces 24, 25. The slide locker 6 is fitted into the receiving part 9 of the trigger block 5 from above. In other words, the slide locker 6 is mounted by fitting the T-shaped piece 19 into the longitudinal cutout 8*a* and the upwardly-opened groove 12 of the trigger block 5, and by fitting the side plate portion 20 into the lateral cutout 8*b* thereof. At this time, the second spring 13 is placed so that its upper end abuts against the underside of the base of the T-shaped piece 19.

The slide locker 6 is arranged so that it is manipulated in the direction perpendicular (vertical direction) to the direction in which the trigger 1 is pulled (longitudinal direction).

In normal condition, the ball 17 kept in contact with the first spring 11 is made to mate with the lower slit 27 of the three leg pieces of the slide locker 6. Although the slide locker 6 is normally urged upward by the second spring 13 and held in the upper position, the ball 17 will go over the lower slit 27 and mate with the upper slit 26 if the slide locker 6 is lowered with the knob 21. The slide locker 6 is thus held in the lower position against the second spring 13. Then the projection 22 at the lower front end of the T-shaped piece 19 moves onto the moving locus of the mating projection 15 of the trigger 1 in the course of a stroke. While the slide locker 6 remains in the upper position, the projection 22 is set away from the moving locus of the mating projection 15 of the trigger 1.

When the trigger 1 makes a full-stroke movement while the slide locker 6 remains in the lower position, the contact piece 16 is made to pass through the upper slit 26 of the slide locker 6.

With the arrangement above, the slide locker 6 is normally held in the upper position as shown in FIGS. 2(*a*), 2(*b*). When the screw tightener is driven by pulling the trigger 1 in this state, the trigger 1 moves deeply inward along the guide groove 7*c* of the trigger block 5 and the contact piece 16 of its insert piece 14 passes through the lower slit 27 of the slide locker 6, so that the first spring 11 is bent. When the pulling action toward the slide locker 6 is released, the trigger 1 is pushed back by the first spring 11 in the direction opposite to the direction in which it is pulled (forward) and reset to the original position.

Figure 4:
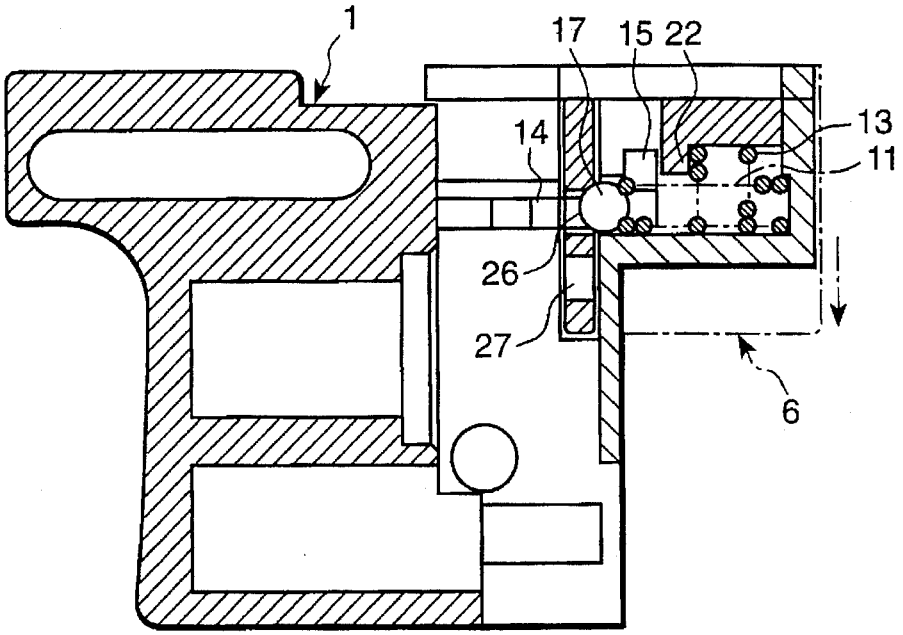
FIG. 4 shows a sectional side view of the locking mechanism locked in its inoperative state.

Subsequently, while the screw tightener is not being used after completion of the work, for example, the slide locker 6 is pushed down by means of the knob 21 to the lower position as shown in FIG. 4, whereby the projection 22 beneath the end plate of the T-shaped piece 19 of the slide locker 6 moves onto the moving locus of the mating projection 15 of the trigger 1. Consequently, the trigger 1 cannot be pushed into the trigger block 5 since the mating projection 15 engages with the projection 22 of the slide locker 6 even when it is attempted to pull the trigger 1 in that state. As the trigger 1 is locked so that it cannot be pulled, malfunction can effectively be prevented.

Figure 5:
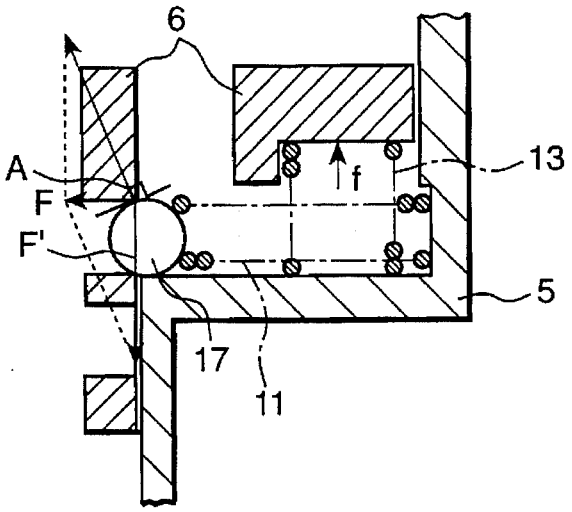
FIG. 5 shows an enlarged view of the principal part in the state of FIG. 4.

By setting a component force F' of the spring force F of the first spring 11 at a point A greater than the spring force f of the second spring 13 as shown in FIG. 5, the slide locker 6 is never pushed up. Accordingly, the setting of F'>f>w (w: weight of the slide locker 6) may be justified.

Figure 6:
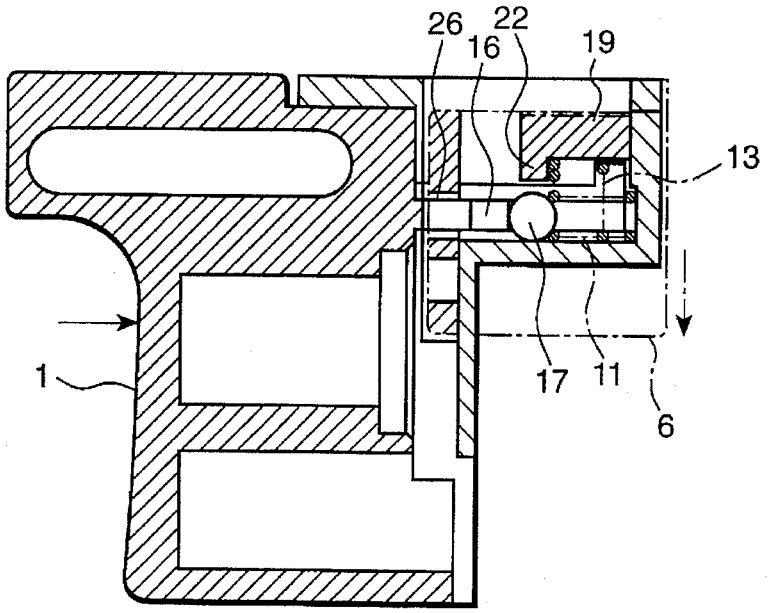
FIG. 6 shows a sectional side view showing the locking mechanism locked in its operative state to keep the driver bit rotating.
Figure 7:
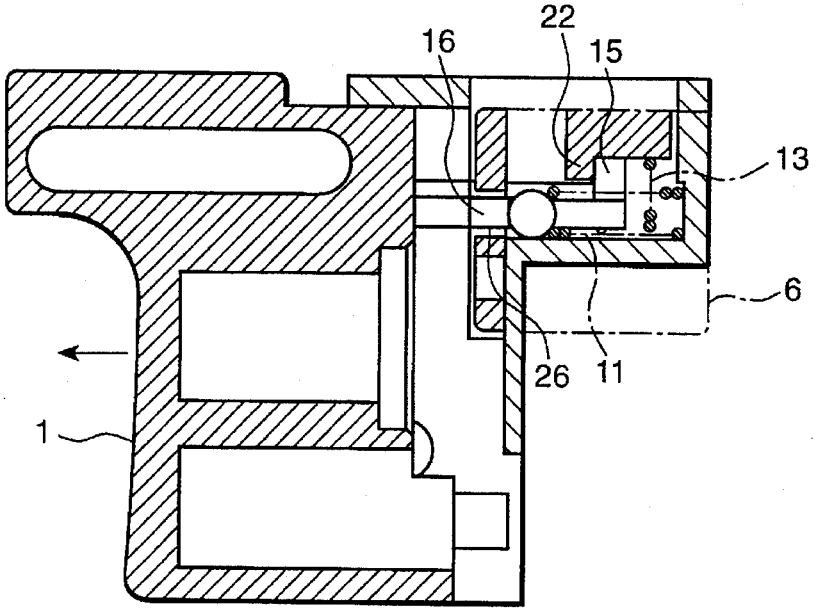
FIG. 7 shows a side view showing an operating state in which the operation of keeping the driver bit rotating is effected.

When the motor 3 is desired to be kept running even after the trigger 1 is released from being pulled during the screw-tightening operation, moreover, the slide locker 6 is pushed down to the lower position after the trigger 1 is pulled as shown in FIG. 6 to move the projection 22 beneath the T-shaped piece 19 of the slide locker 6 onto the moving locus of the mating projection 15 of the trigger 1. When the trigger 1 is released from being pulled in this state, the mating projection 15 of the trigger 1 engages with the projection 22 of the slide locker 6 in the course of its return movement as shown in FIG. 7, whereby the reset movement of the trigger 1 is prevented. The motor 3 can thus be locked so as not to stop running, which makes it possible to perform the screw-driving operation continuously while the driver bit 2 is kept rotating.

Since the contact piece 16 of the insert piece 14 of the trigger 1 is forced into the upper slit 26 of the slide locker 6 in this case, the slide locker 6 is not allowed to make an upward reset movement. On the contrary, by forcing in the trigger 1 against the force of the first spring 11 again, the contact piece 16 is released from mating with the upper slit 26 as in the state of FIG. 6 likewise and the slide locker 6 is reset by the second spring 13 to the upper position; the locking condition above is released accordingly.

As set forth above, the locking mechanism above is capable of locking the trigger 1 in its inoperative position so as not to be pulled and also is capable of locking the motor 3 in an operative state. Improvement in safety as well as operability can thus be accomplished.

What is claimed is:

1. A switch-locking mechanism adaptable for a screw tightener containing a rotatable driver bit, said switch-locking mechanism comprising:

an activatable trigger for activating said rotatable driver bit, said trigger containing a mating projection;

a trigger block slidably accommodating said trigger at least in part such that said mating projection of said trigger is receivable in said trigger block, said trigger block being fixed to a housing of said screw tightener;

a first means for biasing the trigger in a opposite direction to a trigger activating direction at all times; and a slide locker movable between at least a first position and a second position in a direction perpendicular to the trigger activating direction, said slide locker being engagable with said mating projection of said trigger when said slide locker is in the second position, wherein said slide locker is constructed and arranged to allow movement from the first position to the second position and thereby engage said mating projection of said trigger when said trigger is activated so as to lock said trigger in an operative position and thus maintain rotation of said rotatable driver bit, and further wherein said slide locker is constructed and arranged to allow movement from the first position to the second position and thereby engage said mating projection of said trigger when said trigger is deactivated so as to lock said trigger in an inoperative position and thus prevent rotation of said rotatable driver bit.

2. A switch-locking mechanism according to claim 1, further comprising:

a second means biasing said slide locker towards the first position in which said slide locker is not engagable with said mating projection of said trigger.

3. A switch-locking mechanism according to claim 2, wherein:

said trigger further contains a contact portion;

said slide locker contains at least three spaced leg portions defining first and second slits between said leg portions, said first slit slidably receiving said contact portion of said trigger when said slide locker is in the first position and said trigger is activated, and said second slit slidably receiving said contact portion of said trigger when said slide locker is in the second position and said trigger is activated;

a ball is selectively engagable with one of said two slits of said slide locker when said trigger is not activated; and said contact portion of said trigger slidably moves through said one of said two slits of said slide locker and thereby separates said ball from said one of said two slits of said slide locker when said trigger is activated.

4. A switch-locking mechanism according to claim 3, wherein said ball is biased against said one of two slits of said slide locker by said first biasing means.

5. A switch-locking mechanism according to claim 1, wherein said slide locker has an operative knob adaptable to move said slide locker between the first and second positions.

* * * * *